US005613484A

United States Patent [19]

Troncoso

[11] Patent Number: 5,613,484

[45] Date of Patent: Mar. 25, 1997

[54] ARCHERY BOW AND CONNECTOR-STABILIZER ASSEMBLY AND IMPROVED CONNECTOR-STABILIZER SUB-ASSEMBLY FOR THE SAME

[75] Inventor: Vincent Troncoso, Montrose, Colo.

[73] Assignee: Golden Key Futura, Inc., Montrose, Colo.

[21] Appl. No.: 598,268

[22] Filed: Feb. 7, 1996

[51] Int. Cl.[6] ..... F41B 5/00

[52] U.S. Cl. ..... 124/89; 124/86; 403/325

[58] Field of Search ..... 124/89, 86, 88; 403/DIG. 4, 325, 110; 285/316, 92, 86

[56] References Cited

U.S. PATENT DOCUMENTS

| | | | |
|---|---|---|---|
| 2,934,359 | 4/1960 | Smisko et al. | 285/86 |
| 3,218,025 | 11/1965 | Abelson et al. | 285/86 X |
| 3,413,018 | 11/1968 | Francis | 285/86 |
| 3,442,541 | 5/1969 | Metz | 285/86 X |
| 4,245,612 | 1/1982 | Finlay | 124/89 |
| 4,543,993 | 10/1985 | Calvin et al. | 285/316 |
| 4,645,372 | 2/1987 | Suzuki | 403/325 |
| 5,038,510 | 8/1991 | Duke | 124/86 X |
| 5,090,396 | 2/1992 | Bickel et al. | 124/89 |
| 5,165,728 | 11/1992 | Mayer | 285/12 |
| 5,513,622 | 5/1996 | Musacchia, Sr. | 124/89 |
| 5,520,164 | 5/1996 | Huddleston | 124/89 X |
| 5,558,078 | 9/1996 | Dunlap | 124/89 |

FOREIGN PATENT DOCUMENTS

| | | | |
|---|---|---|---|
| 1152093 | 5/1969 | United Kingdom | 285/86 |

*Primary Examiner*—Terry Lee Melius
*Assistant Examiner*—Thomas A. Beach
*Attorney, Agent, or Firm*—Donald E. Nist

[57] ABSTRACT

The improved assembly includes an archery bow to which a connector and stabilizer sub-assembly are releasably secured. The sub-assembly features a connector having inner and outer concentric tubular sleeves with a spring therebetween biasing the outer sleeve toward an annular rim at the end of the inner sleeve which is adjacent to the stabilizer. Spaced bearings are disposed in an annular array in openings in the inner sleeve adjacent the end towards which the outer sleeve is biased. When the outer sleeve is retracted against the spring bias, the bearings can be moved into pockets defined in the outer sleeve by a nut on the free end of a bolt extending from one end of the stabilizer into the inner sleeve so that the nut can move past the bearings. When the outer sleeve is then allowed to be spring biased into its resting position against the inner sleeve rim, the bearings are forced radially inwardly by an annular shelf or detent of the outer sleeve to trap the nut behind the bearings and thus hold the stabilizer against the connector. Thereafter when the connector is tightened against the stabilizer, the outer sleeve cannot be retracted because of the wedging action of the nut and detent against the bearings. Accordingly, locking of the stabilizer and connector together and unlocking them is simple, rapid and positive.

7 Claims, 1 Drawing Sheet

ARCHERY BOW AND CONNECTOR-STABILIZER ASSEMBLY AND IMPROVED CONNECTOR-STABILIZER SUB-ASSEMBLY FOR THE SAME

BACKGROUND OF THE INVENTION

1. Field of the Invention

The present invention generally relates to improved sports equipment and more particularly to an improved archery bow-stabilizer- and connector assembly.

2. Prior Art

Archery bow stabilizers of various sizes, shapes and types have become popular, both for target archery and field archery. Such stabilizers are designed to better balance the archery bow for easier and more accurate aiming, and also to control the reaction of the bow during and after release of an arrow from the drawn bowstring. Thus, one of the functions of the stabilizer usually is to cushion the recoil of the bow during and after shooting.

Most stabilizers are releasably attached to the archery bow by means of an elongated threaded bolt which either protrudes from the bow and is screwed into the stabilizer, or the reverse. The bolts are made long so that the stabilizer will not wobble or easily become loose on the bow during shooting.

However, this means of connection has some drawbacks. Thus, it is not easy to switch from one stabilizer to another because of the long time it takes to unscrew the stabilizer and screw another in its place. In certain circumstances, due, for example, to the terrain which a game hunting archer must sometimes traverse in order to get close enough to the game for a reasonably accurate shot, or due to the necessity of switching or entirely eliminating a stabilizer for proper tuning of the archery bow, a quick, positive disconnect and connect means for bow stabilizers would be most desireable.

Such device should be capable of fitting all stabilizers without major adjustment and should be capable of rapidly and positvely locking the stabilizer in place so that it does not wobble or become loose in use on the bow. Bow vibrations during shooting are sufficiently great to cause gradual loosening of most stabilizer connections, with undesireable results. Moreover, the stabilizer connector should be simple, durable, inexpensive and efficient.

SUMMARY OF THE INVENTION

The improved assembly and sub-assembly of the present invention staisfy all the foregoing needs. The assembly and sub-assembly are simple, rapid and easy to use, adaptable to all stabilizers with major modifications and cause positive locking of the stabilizer to the connector with quick connecting of the stabilizer to and disconnecting it from the connector.

The main features of the assembly and sub-assembly of the present invention are set forth in the ABSTRACT OF THE DISCLOSURE. Thus, the assembly comprises an archer bow with an improved type of connector releasably connected thereto and a stabilizer connected to the connector. The sub-assembly comprises the stabilizer and connector array.

The stabilizer has an elongated threaded bolt extending longitudinally from the rear end thereof and bearing a ring or nut threaded theron for screwing to a desired operative position. The bolt and nut or ring are inserted into a central elongated cavity in an inner annular sleeve forming one part of the connector. An outer annular sleeve is disposed around the sidewall of the inner sleeve and is biased by a spring toward a flange or rim at the stabilizer end of the inner sleeve.

A spaced pluarlity of ball bearings is disposed in an annular array in openings in the central space of the inner sleeve. The ball bearings are biased radially inwardly by a detent on the inner surface of the outer sleeve when the outer sleeve is not retracted against the spring bias, but those bearings can be moved radially outwardly by the nut so that it can pass to a position behind them when the outer sleeve is retracted.

When it is desired to connect the stabilizer and connector, the outer sleeve is retracted while the bolt and nut are inserted into the central cavity so that the nut passes the bearings. The outer sleeve is then released so that its detent forces the bearings into a nut-trapping position, holding the stabilizer and connector together.

When the connector is screwed tightly against the stabilizer, the nut and detent act to lock tightly against the bearings so that the outer sleeve cannot be retracted and the connector is thus locked to the stabilizer.

The opposite end of the connector, that is, the inner sleeve, is releasably connected to a threaded bolt from the bow or vice versa. Once so connected, the connector can be left in place, whether or not the stabilizer is connected.

Rapid disconnection of the stabilizer can be achieved merely by turning the inner sleeve enough to loosen its connection with the stabilizer face, thus, then permitting the retraction of the outer sleeve and the quick withdrawal of the bolt and nut of the stabilizer from the connector. Rapid connection of the stabilizer to the connector involves the retraction of the outer sleeve, insertion of nut and bolt, release of the outer sleeve and a quick turn of the inner sleeve to lock the stabilizer and connector together.

The stabilizer and connector can be made of conventional materials, such as brass, aluminum, steel, titanium, copper or other metals, cermets and other durable materials, as desired.

Various other features of the improved assembly and sub-assembly of the present invention are set forth in the following detailed description and accompanying drawings.

DRAWINGS

FIG. 1 is a schematic side elevation, partly broken away, of a preferred embodiment of the improved assembly and sub-assembly of the present invention; and, FIG. 2 is an enlarged schematic longitudinal cross-section of the improved connector of FIG. 1, showing a portion of the bow and stabilizer of FIG. 1 connected thereto.

DETAILED DESCRIPTION

Figure 1:
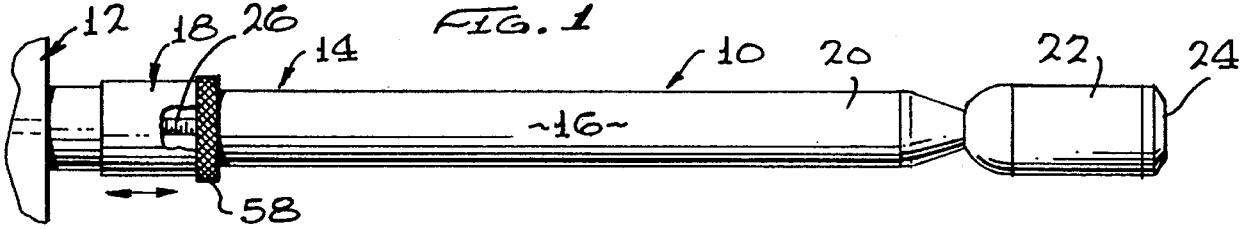
Figure 2:
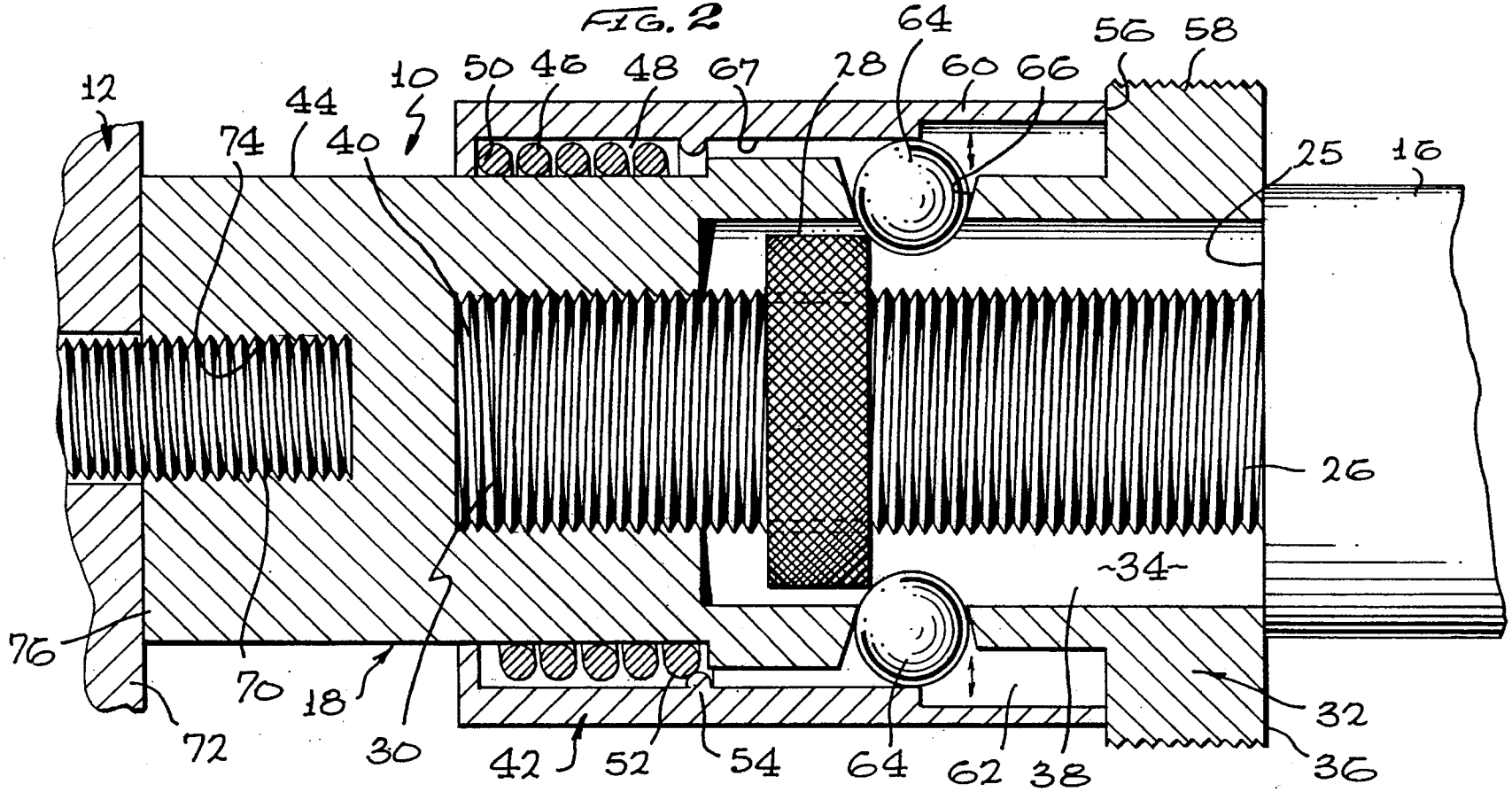

FIGS. 1 and 2.

Now referring more particularly to FIGS. 1 and 2 of the drawings, a preferred embodiment of the improved assembly of the present invention is schematically set forth therein. Thus, assembly 10 is shown, which comprises an archery bow 12 and a sub-assembly 14 comprising an archery bow stabilizer 16 and an improved type of stabilizer connector 18.

Archery bow 12 can be of any suitable type which has means for connecting stabilizer 16 thereto, as hereinafter more fully described. Stabilizer 16 comprises any suitable archery bow stabilizer such as an elongated rod 20 having an integral weight 22 at the front end 24 thereof and an elongated externally threaded bolt 26 extending rearwardly from the rear end end 25 thereof along the longitudinal axis of stabilizer 16. However, stabilizer 16 has an additional feature, namely an internally threaded ring or nut 28 threaded over the free end 30 of bolt 26 and of larger diameter than bolt 26.

Ring 28 cooperates with connector 18 to releasably hold stabilizer 16 to connector 18, as more fully described hereinafter. Connector 18 comprises an elongated inner generally cylindrical sleeve 32 defining a generally central space or cavity 34 extending part of the way through sleeve 32 along the longitudinal axis of sleeve 32 from its front end 36. Space 34 is generally cylindrical with a front portion 38 of greater diameter than its rear portion 40. Rear portion 40 is dimensioned and threaded to act as a guide and anti-wobbler anchor for free end 30 of bolt 26 when it is inserted into space 34 to the position shown in FIG. 2.

Connector 18 also includes an outer generally cylindrical sleeve which slides over the outer surface of the sidewall 44 of inner sleeve 32. A cylindrical coiled spring 46 is disposed around sidewall 44, as shown in FIG. 2, in an annular space 48 between sleeves 32 and 42 and has its rear end 50 pinned to inner sleeve 32. As sleeve 42 is retracted rearwardly, spring 46 is compressed, its front end 52 being trapped by detent 54 in sleeve 42. Accordingly, sleeve 42 is spring biased to the forward position shown in FIG. 2. The front end 56 of sleeve 42 when that sleeve is in the forward resting position abuts an expanded ring or rim 58 of inner sleeve 32.

The front portion 38 of sleeve 32 and the front portion 60 of sleeve 42 are dimensioned to cooperatively define an annular space 62 therebetween. A plurality of ball bearings 64 are spaced from one another in a ring configuration in openings 66 in the front portion 38 of sidewall 44 adjacent space 62. When sleeve 42 is in the forward spring-biased position of FIG. 2, the inner surface 67 of sleeve 42 forces bearings 64 radially inwardly to the position shown in FIG. 2. However, when sleeve 42 is moved rearwardly against the biasing of spring 46, bearings 64 can move radially outwardly into space 62.

When it is desired to insert bolt 26 into space 34 to connect stabilizer 16 to connector 18, outer sleeve 42 is retracted and held in the retracted position while bolt 26 is moved into space 34 to a position where ring 28 is rearwardly of bearings 64, bearings 64 being easily pushed radially outwardly by ring into space 62. The exact positioning of ring 28 on bolt 26 to accomplish this can be done by turning ring 28 on bolt 26 and screwing the free end 30 of bolt 26 into threaded rear portion 40 of space 34.

Sleeve 42 is then released and spring biased into its resting position, with the front portion 60 of inner surface 67 which is adjacent space 62 having the effect of driving bearings 64 radially inwardly in front of ring 28, trapping ring 28 in space 34. In order to lock outer sleeve 42 against inadvertant retraction of sleeve 42 and inadvertant uncoupling of connector 18 and stabilizer 16, sleeve 32 is rotated a quarter turn to screw it up tight against stabilizer 16 and to move ring 28 into direct forcing contact with bearings 64, thus wedging bearings 64 tightly in openings 66 between surface 67 and the leading edge of ring 28 so that they will not move if it is attempted to retract sleeve 42. Accordingly, stabilizer 16 is rapidly and conveniently locked to connector 18.

Stabilizer 16 can be easily removed from connector 18 merely by counter-rotating sleeve 32 to move ring 28 rearwardly of bearings 64, after which bolt 26 and ring 28 can be easily pulled out of space 34, bearings 64 moving into space 62 when passed by ring 28.

Connector 18 can be attached easily to bow 12 and left in place thereon for use in connecting stabilizer 16 when desired. This connection of bow 12 and connector 18 can be accomplished, for example, by installing an elongated threaded bolt 70 in the front end 72 of bow 12 so as to project horizontally forwardly thereof and be threadingly received in a threaded opening 74 in the rear end 76 of connector 18. Bolt 70 can, if desired, be located in a different position on bow 12 such as at an angle from the horizontal and/or on the side of bow 12. A series of connectors 18 can, if desired, be installed on a series of bolts 70 located at various positions on bow 12.

Alternatively, rear end 76 of connector 18 can have bolt 70 permanently installed in it and projecting rearwardly thereof for threaded insertion in a suitable opening in bow 12. Other conventional ways of installing bow accessories can be used instead of the just-described ways.

Connector 18 and stabilizer 16 can be fabricated of metal, such as steel, bronze, brass, copper, aluminum, titanium and the like or of other suitable materials.

Various modifications, changes, alterations and additions can be made in the improved assembly and sub-assembly of the present invention, including their components and parameters. All such modifications, changes, alterations and additions as are within the scope of the appended claims form part of the present invention.

What is claimed is:

1. An improved archery bow and stabilizer assembly, said assembly comprising, in combination:

a) an archery bow having means releasably receiving an archery bow stabilizer and connector sub-assembly; and, b) an archery bow stabilizer and connector sub-assembly, said sub-assembly comprising, in combination:

i) an elongated archery bow stabilizer having a rear end and an opposite front end, said rear end having an externally threaded bolt extending rearwardly thereof along the longitudinal axis of said stabilizer and bearing an internally threaded nut of greater diameter than said bolt threaded on said bolt; and, ii) an improved quick-disconnect connector releasably securable to said stabilizer and to said archery bow, said connector comprising, in combination:

a) an inner tubular elongated sleeve having first and second opposite ends and an annular sidewall, said first opposite end defining a central elongated space extending along the longitudinal axis of said connector and receiving said bolt and nut, and said second opposite end containing means releasably connecting said connector to said archery bow through said bow sub-assembly-receiving means;

b) an outer sleeve disposed around said annular sidewall and concentric therewith and slideable longitudinally between a first position abutting said first opposite end of said first sleeve and a second position toward said second opposite end, said outer sleeve defining with said inner sleeve a spring-receiving recess;

c) a spring disposed in said recess between said inner and outer sleeves, concentric with said sleeves and biasing said second sleeve toward said first opposite end; and, d) a plurality of bearings disposed in a spaced array in openings in said inner sleeve adjacent said first opposite end, said bearings moveable between a first position wherein the diametrical spacing between said bearings is less than the diameter of said nut and a second position wherein said bearings have a diamterical spacing larger than the diameter of said nut, said outer sleeve defining a bearing-receiving annular pocket adjacent said first opposite end and a bearing-forcing detent at the inner end of said pocket, whereby a) when thereafter said outer sleeve is retracted against said spring biasing, said nut biases said bearings into said pocket and passes toward said second opposite end past said bearings, b) when thereafter said outer sleeve is spring biased toward said first opposite end said nut is trapped in said central space by said bearings, holding said stabilizer fixed to said connector and c) when thereafter said inner sleeve is tightened against said stabilizer, said nut and detent lock said outer sleeve and bearings together so that said outer sleeve cannot be retracted.

2. The improved assembly of claim 1 wherein said bow stabilizer-receiving means comprises a threaded bolt threadably received in an opening in said second opposite end of said inner sleeve.

3. The improved assembly of claim 1 wherein said bow stabilizer-receiving means comprises a threaded opening releasably receiving a threaded bolt extending thereinto from said second opposite end of said inner sleeve.

4. The improved assembly of claim 1 wherein the portion of said central space closest to said second opposite end has a diameter such that the free end of said bolt is threadably received therein, thus preventing wobbling of said stabilizer.

5. An improved archery bow stabilizer and connector sub-assembly, said sub-assembly comprising, in combination:

a) an elongated archery bow stabilizer having a rear end and an opposite front end, said rear end having an externally threaded bolt extending rearwardly thereof along the longitudinal axis of said stabilizer and bearing an internally threaded nut of greater diameter than said bolt threaded on said bolt; and, b) an improved quick-disconnect connector releasably secured to said stabilizer, said connector comprising, in combination:

i) an inner tubular elongated sleeve having first and second opposite ends and an annular sidewall, said first opposite end defining a central elongated space extending along the longitudinal axis of said connector and receiving said bolt and nut, and said second opposite end containing means for releasably connecting said connector to an archery bow;

ii) an outer tubular sleeve concentrically disposed around said annular sidewall and slideable longitudinally between a first position adjacent said first opposite end of said first sleeve and a second position toward said second opposite end, said outer sleeve defining with said inner sleeve a spring-receiving recess;

iii) a spring disposed in said recess between said inner and outer sleeves and biasing said second sleeve toward said first opposite end; and, iiii) a plurality of bearings disposed in a spaced annular array in openings in said inner sleeve adjacent said first opposite end, said bearings being moveable between a first position wherein the diametrical spacing between said bearings is less than the diameter of said nut and a second position wherein said bearings have a diametrical spacing larger than the diameter of said nut, said outer sleeve defining a bearing-receiving annular pocket adjacent said first opposite end and a bearing-forcing detent at the distal end of said pocket, whereby a) when said outer sleeve is retracted against said spring biasing during insertion of said bolt and nut into said space, said nut biases said bearings into said pocket and passes toward said second opposite end past said bearings, b) when thereafter said outer sleeve is spring biased toward said first opposite end, said nut is trapped in said central space by said bearings, holding said stabilizer fixed to said connector and c) when thereafter said inner sleeve is tightened against said stabilizer, said nut and detent lock said outer sleeve and bearings together so that said outer sleeve cannot be retracted.

6. The improved sub-assembly of claim 5 wherein said inner sleeve has an annular rim against which one end of said outer sleeve is biased by said spring.

7. The improved sub-assembly of claim 6 wherein said second opposite end has one of a) an internally threaded cavity for receiving an externally threaded bolt connected to an archery bow, and b) an externally threaded bolt for threadably inserting into an internally threaded cavity in an archery bow.

* * * * *